US011760599B2

(12) United States Patent
Susaki

(10) Patent No.: US 11,760,599 B2
(45) Date of Patent: Sep. 19, 2023

(54) POST-PROCESSING APPARATUS AND IMAGE FORMING SYSTEM INCORPORATING THE POST-PROCESSING APPARATUS

(71) Applicant: Yuji Susaki, Kanagawa (JP)

(72) Inventor: Yuji Susaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/744,759

(22) Filed: May 16, 2022

(65) Prior Publication Data

US 2022/0371849 A1 Nov. 24, 2022

(30) Foreign Application Priority Data

May 24, 2021 (JP) ..... 2021-087023

(51) Int. Cl.
*B65H 33/14* (2006.01)
*B65H 43/06* (2006.01)

(52) U.S. Cl.
CPC ..... *B65H 33/14* (2013.01); *B65H 43/06* (2013.01)

(58) Field of Classification Search
CPC ..... B65H 33/14; B65H 43/06; B65H 45/18; B65H 31/02; B65H 2405/11152; B65H 2405/11162; B65H 2405/11172; B65H 2405/1117; B65H 31/30; B65H 31/3054
See application file for complete search history.

(56) References Cited

U.S. PATENT DOCUMENTS 5,098,074 A 3/1992 Mandel et al.
6,330,999 B2 * 12/2001 Coombs ..... B65H 29/34 270/58.08
6,428,000 B1 * 8/2002 Hara ..... B65H 31/20 271/223
6,450,934 B1 * 9/2002 Coombs ..... G03G 15/6541 493/383

(Continued)

FOREIGN PATENT DOCUMENTS

JP 10-265115 A 10/1998
JP 2005-298127 A 10/2005

(Continued)

OTHER PUBLICATIONS

Extended European Search Report dated Nov. 2, 2022, issued in corresponding European Patent Application No. 22169692.5.

*Primary Examiner* — Patrick H Mackey
(74) *Attorney, Agent, or Firm* — XSENSUS LLP

(57) ABSTRACT

A post-processing apparatus includes a post-processing device, an ejection device, and an ejection tray. The post-processing device executes post-processing on a medium on which an image is formed by an image forming apparatus. The ejection device ejects the medium on which the post-processing is executed by the post-processing device. The ejection tray holds the medium ejected by the ejection device. The ejection tray includes a main tray having an upper face inclined downward in an ejection direction, and a movable tray being rotatably supported by the main tray between a stacking position at which the medium ejected by the ejection device remains stacked on the upper face of the main tray and an ejection position at which the medium ejected by the ejection device slides along the upper face of the main tray.

11 Claims, 7 Drawing Sheets

(56) References Cited

U.S. PATENT DOCUMENTS

| | | | | |
|---|---|---|---|---|
| 6,685,180 | B2 * | 2/2004 | Saegusa | B65H 31/00 270/58.08 |
| 6,722,646 | B2 * | 4/2004 | Sekiyama | B65H 43/06 270/58.11 |
| 9,139,395 | B2 * | 9/2015 | Niikura | B65H 29/00 |
| 9,177,213 | B2 * | 11/2015 | Chmielewski | G08G 1/163 |
| 9,830,542 | B2 * | 11/2017 | Unno | G06K 15/403 |
| 2006/0078363 | A1 * | 4/2006 | Terao | B42C 1/12 271/220 |
| 2016/0031669 | A1 * | 2/2016 | Mori | G03G 15/502 270/1.01 |
| 2017/0066616 | A1 | 3/2017 | Endo et al. | |
| 2020/0307936 | A1 * | 10/2020 | Sugawara | B65H 9/004 |
| 2021/0094786 | A1 * | 4/2021 | Mizushima | B65H 31/02 |

FOREIGN PATENT DOCUMENTS

| | | |
|---|---|---|
| JP | 2012-250844 | 12/2012 |
| JP | 2016-033071 | 3/2016 |

* cited by examiner

POST-PROCESSING APPARATUS AND IMAGE FORMING SYSTEM INCORPORATING THE POST-PROCESSING APPARATUS

CROSS-REFERENCE TO RELATED APPLICATION

This patent application is based on and claims priority pursuant to 35 U.S.C. § 119(a) to Japanese Patent Application No. 2021-087023, filed on May 24, 2021, in the Japan Patent Office, the entire disclosure of which is hereby incorporated by reference herein.

BACKGROUND

Technical Field

Embodiments of the present disclosure relate to a post-processing apparatus and an image forming system incorporating the post-processing apparatus.

Background Art

In the related art, post-processing apparatuses are known to execute post-processing on a sheet on which an image is formed by an image forming apparatus. For example, the post-processing executed by a post-processing apparatus includes saddle stitching in which a plurality of bundled sheets (hereinafter referred to as a "sheet bundle") are bound at the center.

Such a post-processing apparatus may continuously perform saddle stitching on a large number of sheet bundles. To perform saddle stitching continuously, some post-processing apparatuses are provided with a sheet ejection tray that is inclined, so that sheet bundles are continuously ejected to fall from the sheet ejection tray.

SUMMARY

Embodiments of the present disclosure described herein provide a novel post-processing apparatus including a post-processing device, an ejection device, and an ejection tray. The post-processing device executes post-processing on a medium on which an image is formed by an image forming apparatus. The ejection device ejects the medium on which the post-processing is executed by the post-processing device. The ejection tray holds the medium ejected by the ejection device. The ejection tray includes a main tray having an upper face inclined downward in an ejection direction, and a movable tray being rotatably supported by the main tray between a stacking position at which the medium ejected by the ejection device remains stacked on the upper face of the main tray and an ejection position at which the medium ejected by the ejection device slides along the upper face of the main tray.

Further, embodiments of the present disclosure described herein provide an image forming system including an image forming apparatus that forms an image on a medium, and the above-described post-processing apparatus that executes the post-processing on the medium on which the image is formed by the image forming apparatus.

BRIEF DESCRIPTION OF THE SEVERAL VIEWS OF THE DRAWINGS

Exemplary embodiments of this disclosure will be described in detail based on the following figures, wherein.

Figure 1:
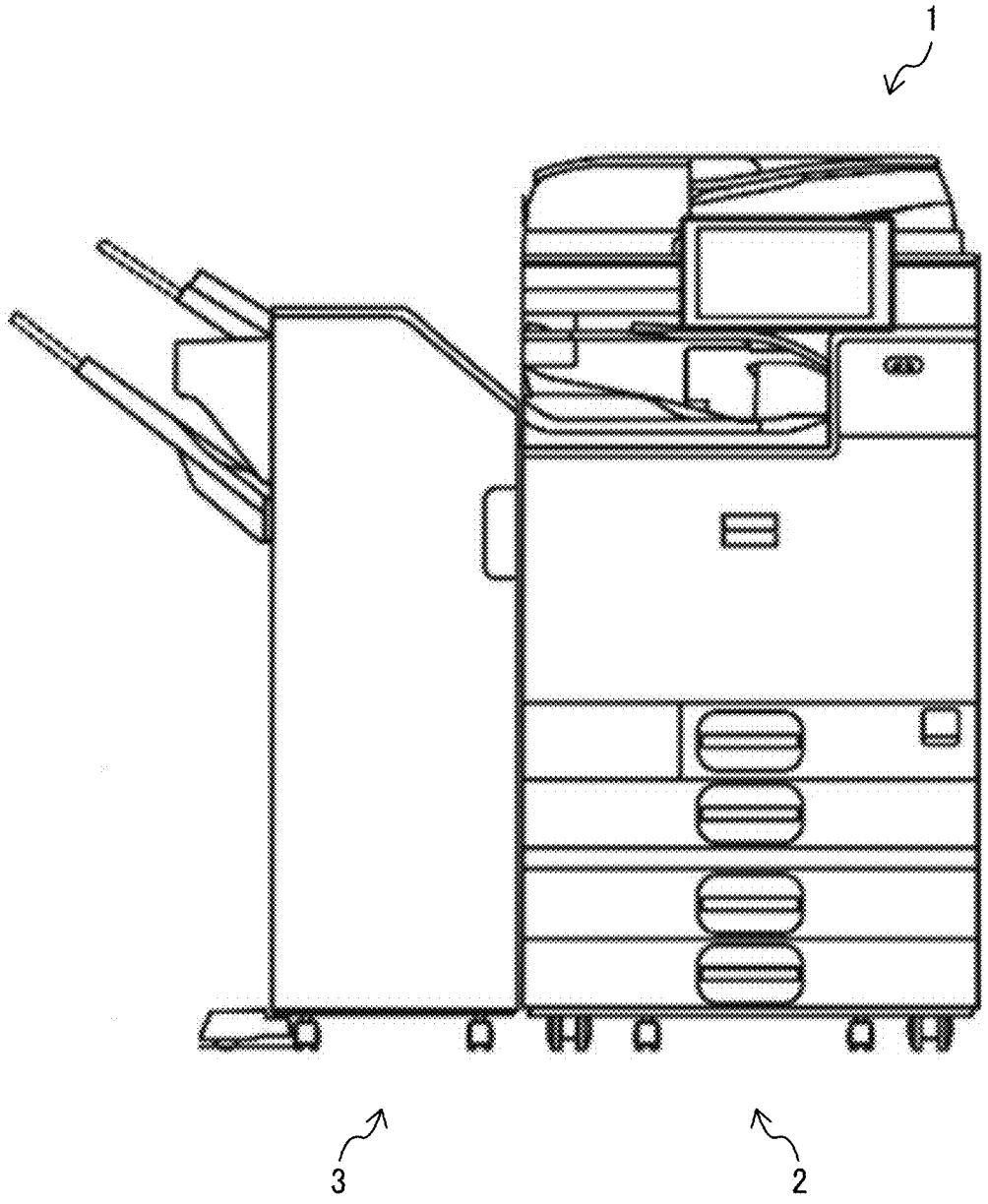
FIG. 1 is a diagram illustrating an overall configuration of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against." "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," w % ben used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components)

having the same function or shape and redundant descriptions thereof are omitted below.

Next, a description is given of a configuration and functions of a post-processing apparatus and an image forming apparatus, according to an embodiment of the present disclosure, with reference to drawings. Note that identical parts or equivalents are given identical reference numerals and redundant descriptions are summarized or omitted accordingly.

Embodiments of the present disclosure are described below with reference to the attached drawings.

Hereinafter, a description is given of an image forming system 1 according to an embodiment of the present disclosure, with reference to the drawings.

FIG. 1 is a diagram illustrating an overall configuration of the image forming system 1.

The image forming system 1 has a function of forming an image on a sheet and executing post-processing on the sheet on which the image is formed. As illustrated in FIG. 1, the image forming system 1 includes an image forming apparatus 2 and a post-processing apparatus 3.

The image forming apparatus 2 forms an image on a sheet (medium) and ejects the sheet having the image to the post-processing apparatus 3. The image forming apparatus 2 mainly includes a tray in which a sheet (sheets) is contained, a medium conveyor that conveys the sheet contained in the tray, and an image forming device that forms an image on the sheet conveyed by the medium conveyor. The image forming device may be an inkjet image forming device in which an image is formed with ink or an electrophotographic image forming device in which an image is formed with toner. Since the image forming apparatus 2 has a typical configuration, a detailed description of configuration and functions of the image forming apparatus 2 is omitted.

Figure 2:
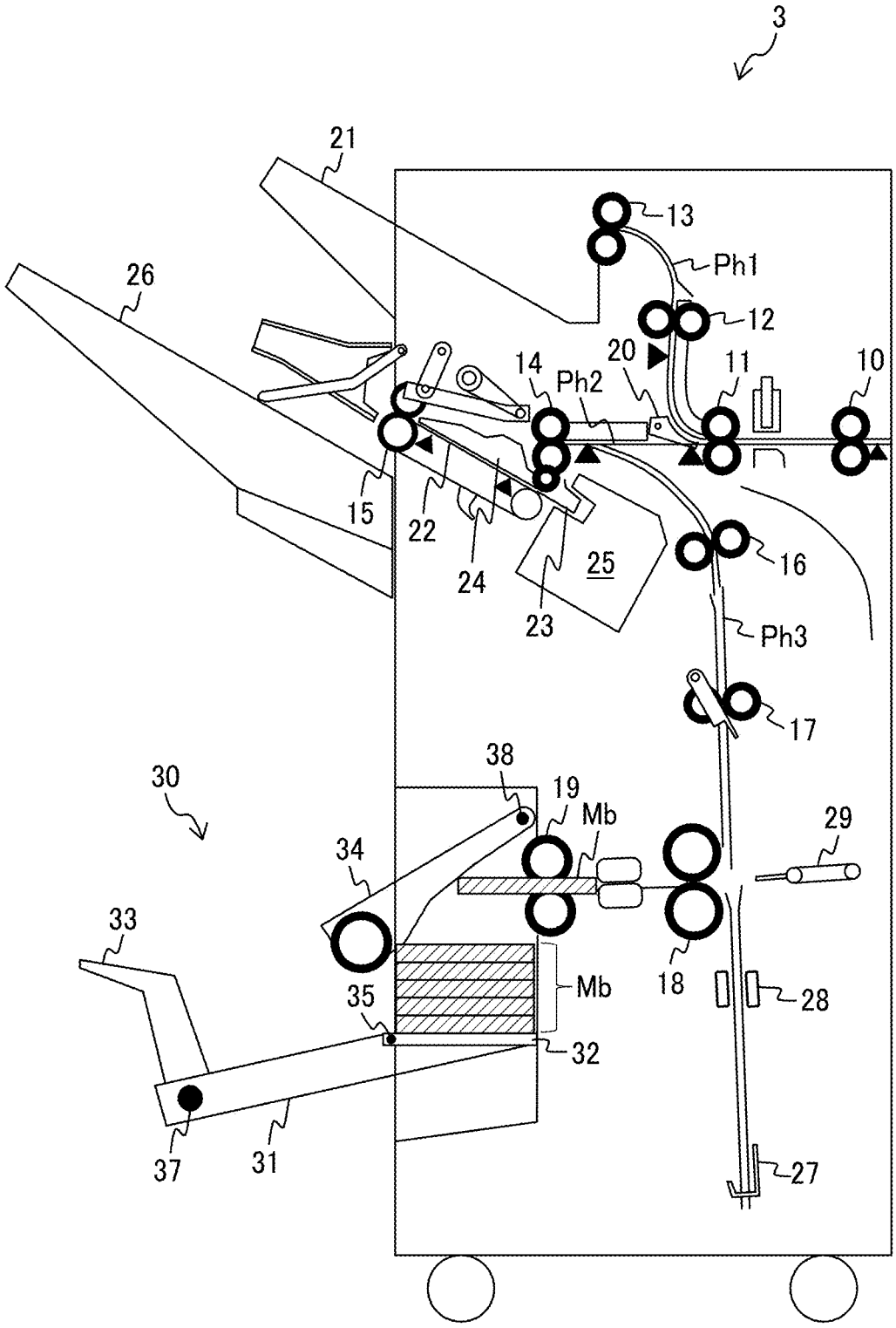
FIG. 2 is a diagram illustrating an internal configuration of a post-processing apparatus included in the image forming system of FIG. 1.

FIG. 2 is a diagram illustrating an internal configuration of the post-processing apparatus 3 included in the image forming system 1 of FIG. 1.

The post-processing apparatus 3 executes post-processing on the sheet on which the image is formed by the image forming apparatus 2. For example, the post-processing executed by the post-processing apparatus 3 according to the present embodiment includes saddle stitching in which sheets each having an image are bound. Hereinafter, the bound sheets are collectively referred to as a "sheet bundle Mb". More specifically, the post-processing apparatus 3 executes an edge stitching process for binding the edge of the sheet bundle Mb and a saddle stitching process for binding the center of the sheet bundle Mb.

The post-processing apparatus 3 includes conveyance roller pairs 10 to 19 and a switching claw 20. The conveyance roller pairs 10 to 19 convey the sheet fed from the image forming apparatus 2 so that the sheet travels inside the post-processing apparatus 3. More specifically, the conveyance roller pairs 10 to 13 convey the sheet along a first conveyance passage Ph1. The conveyance roller pairs 14 and 15 convey the sheet along a second conveyance passage Ph2. Further, the conveyance roller pairs 16 to 19 convey the sheet along a third conveyance passage Ph3.

The first conveyance passage Ph1 is a passage extending from a sheet supporting port from the image forming apparatus 2 to a sheet ejection tray 21. The second conveyance passage Ph2 is a passage branching from the first conveyance passage Ph1 between the conveyance roller pairs 11 and 14 in the conveyance direction of the sheet and extending to a sheet ejection tray 26 via the internal sheet tray 22. The third conveyance passage Ph3 is a passage branching from the first conveyance passage Ph1 between the conveyance roller pairs 11 and 14 in the conveyance direction of the sheet and extending to a sheet ejection tray 30.

The switching claw 20 is disposed at a branching position of the first conveyance passage Ph1 and the second conveyance passage Ph2. The switching claw 20 is switchable between a first position where the sheet is ejected to the sheet ejection tray 21 through the first conveyance passage Ph1 and a second position where the sheet conveyed through the first conveyance passage Ph1 is guided to the second conveyance passage Ph2. At the timing when the trailing end of the sheet entering the second conveyance passage Ph2 passes through the conveyance roller pair 11, the conveyance roller pair 14 is rotated in the reverse direction so that the sheet is guided to the third conveyance passage Ph3. The post-processing apparatus 3 further includes a plurality of sensors that detects the positions of the sheet in the first conveyance passage Ph1, the second conveyance passage Ph2, and the third conveyance passage Ph3. Each of the plurality of sensors is indicated by a black triangle mark in FIG. 2.

The post-processing apparatus 3 further includes a sheet ejection tray 21. The sheet ejection tray 21 supports the sheet ejected through the first conveyance passage Ph1. The sheet ejection tray 21 receives a sheet (or sheets) on which the post-processing is not executed, among the sheets fed from the image forming apparatus 2. In other words, a sheet (or sheets) on which the post-processing is not executed is ejected to the sheet ejection tray 21.

The post-processing apparatus 3 includes the internal sheet tray 22, an end fence 23, side fences 24, a binding unit 25, and a sheet ejection tray 26. The internal sheet tray 22, the end fence 23, the side fences 24, and the binding unit 25 are included in an edge stitching device (post-processing device) that executes an edge stitching process on the sheet conveyed in the second conveyance passage Ph2. Among the sheets fed from the image forming apparatus 2, the sheet ejection tray 26 receives a bundle of sheets (sheet bundle Mb) on which the edge stitching process is executed by the edge stitching device. In other words, a bundle of sheets (sheet bundle Mb) on which the edge stitching process is executed by the end stitching device is ejected to the sheet ejection tray 26.

The internal sheet tray 22 temporarily supports the sheet bundles sequentially conveyed through the second conveyance passage Ph2. The end fence 23 aligns the position of the sheet bundle Mb supported by the internal sheet tray 22 in the conveyance direction of the sheet bundle Mb. The side fences 24 align the position of the sheet bundle Mb supported by the internal sheet tray 22 in the width direction of the sheet bundle Mb orthogonal to the conveyance direction of the sheet bundle Mb. The binding unit 25 binds an end of the sheet bundle Mb aligned by the end fence 23 and the side fences 24. Then, the conveyance roller pair 15 (sheet ejection unit) ejects the sheet bundle Mb subjected to the edge stitching process by the edge stitching device to the sheet ejection tray 26.

The post-processing apparatus 3 further includes an end fence 27, a binding unit 28, a sheet folding blade 29, and a sheet ejection tray 30. The end fence 27, the binding unit 28, and the sheet folding blade 29 are included in a saddle stitching device (post-processing device) that executes a saddle stitching process on sheets conveyed through the third conveyance passage Ph3. Among the sheets fed from the image forming apparatus 2, the sheet ejection tray 30 receives a bundle of sheets (sheet bundle Mb) on which the saddle stitching process is executed by the saddle stitching device. In other words, a bundle of sheets (sheet bundle Mb)

on which the saddle stitching process is executed by the saddle stitching device is ejected to the sheet ejection tray 30.

The end fence 27 aligns the positions of the sheet bundle sequentially conveyed through the third conveyance passage Ph3 in the conveyance direction of the sheet bundle. Further, the end fence 27 is movable between a binding position where the center of the sheet bundle Mb faces the binding unit 28 and a folding position where the center of the sheet bundle Mb faces the sheet folding blade 29. The binding unit 28 binds the center of the sheet bundle Mb aligned by the end fence 27 at the binding position. The sheet folding blade 29 folds the sheet bundle Mb in half while the sheet bundle Mb is supported by the end fence 27 at the folding position, and then causes the conveyance roller pair 18 to nip the sheet bundle Mb. The conveyance roller pairs 18 and 19 (sheet ejection unit) eject the sheet bundle Mb subjected to the saddle stitching process by the binding unit 28 to the sheet ejection tray 30.

Next, a description is given of a detailed configuration of the sheet ejection tray 30, with reference to FIGS. 1, 2, 3A, and 3B.

Figure 3A:
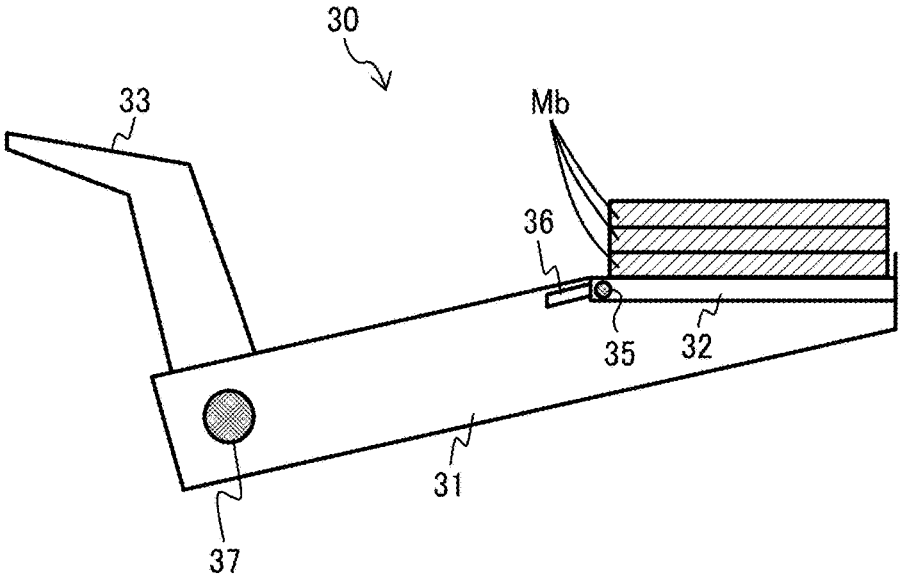
FIGS. 3A and 3B are enlarged views of a sheet ejection tray included in the post-processing apparatus of FIG. 2.
Figure 3B:
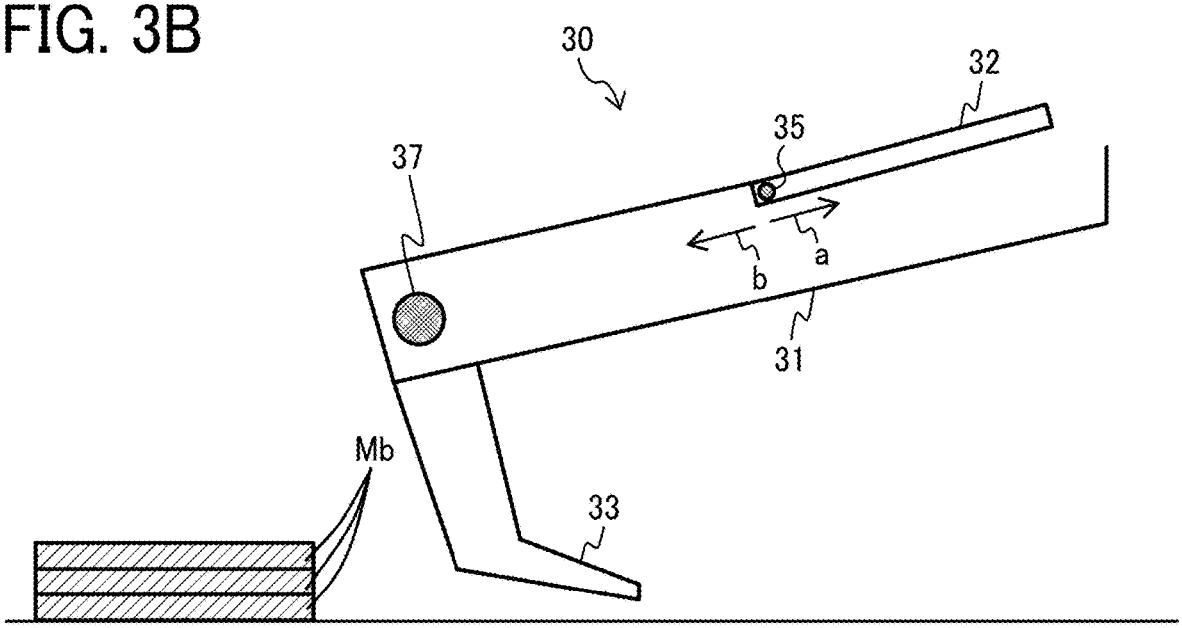

FIGS. 3A and 3B are enlarged views of the sheet ejection tray 30 included in the post-processing apparatus 3 of FIG. 2.

The sheet ejection tray 30 is changeable to an appropriate position in accordance with the number of copies of the sheet bundles Mb that has been subjected to the saddle stitching process and ejected to the outside of the post-processing apparatus 3. The number of copies of the sheet bundles Mb corresponds to the number of copies that are simultaneously stacked on the sheet ejection tray 30. The sheet ejection tray 30 includes a main tray 31, a movable tray 32, a distal end fence 33, and a stacking amount sensor 34.

The main tray 31 is disposed at a position capable of supporting the sheet bundle Mb ejected by the conveyance roller pair 19. More specifically, the main tray 31 is disposed below the conveyance roller pair 19 to protrude outward from the housing of the post-processing apparatus 3. The upper face of the main tray 31 is a sloped face that is inclined downward in the ejection direction (toward the left side of FIG. 2) of the sheet bundle Mb ejected by the conveyance roller pair 19. Further, the main tray 31 supports the movable tray 32 and the distal end fence 33.

The movable tray 32 is provided on the root end of the main tray 31 (upstream side in the discharge direction) and is rotatably supported with respect to the main tray 31 via a support shaft 35. The support shaft 35 extends in the width direction of the sheet bundle Mb that is orthogonal to the ejection direction of the sheet bundle Mb and the vertical direction of the post-processing apparatus 3. Further, the support shaft 35 is attached to a distal end of the movable tray 32 (i.e., the downstream end in the ejection direction of the sheet bundle Mb). That is, the movable tray 32 is rotatable with the downstream end in the ejection direction of the sheet bundle Mb as a rotation base end and the upstream end in the ejection direction of the sheet bundle Mb as a rotation distal end. More specifically, the movable tray 32 rotates between a stacking position illustrated in FIG. 3A and an ejection position illustrated in FIG. 3B.

The stacking position is taken by the movable tray 32 when the sheet bundle Mb ejected by the conveyance roller pair 19 is stacked on the movable tray 32 and is a position at which the sheet bundle Mb maintains for not sliding down due to the inclination of the main tray 31. Therefore, the upper face of the movable tray 32 is horizontal in the stacking position. The ejection position is a position taken by the movable tray 32 when the sheet bundle Mb ejected by the conveyance roller pair 19 is ejected along the inclination of the upper face of the main tray 31. Therefore, the upper face of the movable tray 32 is inclined downward along the upper face of the main tray 31 in the ejection position. More specifically, the movable tray 32 changes the position from the stacking position to the ejection position by rotating so that the downstream end in the ejection direction of the sheet bundle Mb springs up. The angle of inclination of the upper face of the movable tray 32 in the ejection position is set to be equal to or greater than the angle of inclination of the upper face of the main tray 31.

Further, the movable tray 32 is supported by the main tray 31 to be slidable along the inclination direction of the main tray 31. More specifically, as illustrated in FIG. 3A, a guide groove 36 extending along the inclination direction of the main tray 31 is formed on the side face of the main tray 31. The guide groove 36 supports the support shaft 35 rotatably in the axial direction of the main tray 31 and slidably in the inclination direction of the main tray 31.

As the movable tray 32 in the ejection position slides toward the root end of the main tray 31 as indicated by arrow "a" in FIG. 3B, a gap is formed between the upper face of the main tray 31 and the upper face of the movable tray 32. As a result, the movable tray 32 is rotatable between the ejection position and the stacking position. On the other hand, the movable tray 32 in the ejection position slides to the distal end of the main tray 31 in the direction indicated by arrow "b" in FIG. 3B, so that the upper face of the main tray 31 and the upper face of the movable tray 32 are continuously extended as a single face. As a result, no gap is formed between the upper face of the main tray 31 and the upper face of the movable tray 32.

The distal end fence 33 is disposed downstream from the movable tray 32 in the ejection direction of the sheet bundle Mb, in other words, on the distal end of the main tray 31. The distal end fence 33 is rotatably supported by the main tray 31 via a support shaft 37. The support shaft 37 extends in the width direction of the sheet bundle Mb that is orthogonal to the ejection direction of the sheet bundle Mb and the vertical direction of the post-processing apparatus 3. In other words, the support shaft 37 extends in a direction parallel to the axis of the support shaft 35. The distal end fence 33 pivots between a protruding position illustrated in FIG. 3A and a retraction position illustrated in FIG. 3B.

The protruding position is a position at which the distal end fence 33 is protruded upward from the upper face of the main tray 31 and prevents the sheet bundle Mb from being ejected from the main tray 31. Therefore, the protruding position is a position taken by the distal end fence 33 to prevent the sheet bundle Mb from coming off from the main tray 31 when the sheet bundle Mb moves along the upper face of the main tray 31, in other words, when the sheet bundle Mb slides down the sloped face of the main tray 31 that is inclined downward. In the retraction position, the sheet bundle Mb is allowed to be ejected along the upper face of the main tray 31. The retraction position is also a position at which the distal end fence 33 is retracted from the upper face of the main tray 31 and the sheet bundle Mb is ejected from the main tray 31. More specifically, the retraction position is a position at which the distal end fence 33 is retracted below the upper face of the main tray 31.

Further, the distal end fence 33 may change the position in conjunction with movement of the movable tray 32. More specifically, as illustrated in FIG. 3A, the distal end fence 33 may be brought to the protruding position in conjunction with the movable tray 32 changing to the stacking position.

Further, as illustrated in FIG. 3B, the distal end fence 33 may be brought into the retraction position in conjunction with the movable tray 32 changing to the ejection position. In this case, the sheet ejection tray 30 may include a transmission mechanism (for example, gear and belt) that transmits the rotation (change of position) of the movable tray 32, to the distal end fence 33.

Thus, as illustrated in FIG. 3A, when the movable tray 32 is in the stacking position and the distal end fence 33 is in the protruding position, the sheet bundle Mb ejected by the conveyance roller pair 19 is stacked onto the movable tray 32. Even when the sheet bundle Mb slides from the movable tray 32 to the main tray 31, the distal end fence 33 prevents the sheet bundle Mb from falling from the sheet ejection tray 30.

On the other hand, as illustrated in FIG. 3B, when the movable tray 32 is at the ejection position and the distal end fence 33 is in the retraction position, the sheet bundle Mb ejected by the conveyance roller pair 19 or stacked on the movable tray 32 in the stacking position slides down along the upper face of the sloped face of the movable tray 32 and the upper face of the main tray 31 to be ejected from the sheet ejection tray 30.

The stacking amount sensor 34 detects the amount (number) of sheet bundles Mb stacked on the movable tray 32 at the stacking position. The stacking amount sensor 34 is rotatably supported by the housing of the post-processing apparatus 3 via a support shaft 38. Further, the stacking amount sensor 34 contacts the uppermost sheet bundle Mb stacked on the movable tray 32. That is, the angle of the stacking amount sensor 34 changes in accordance with the amount of the sheet bundle Mb stacked on the movable tray 32. The stacking amount sensor 34 outputs a stacking amount signal corresponding to the current angle, to a controller 100 (see FIG. 4). Note that the specific structure of the stacking amount sensor 34 is not limited to the example described above.

Figure 4:
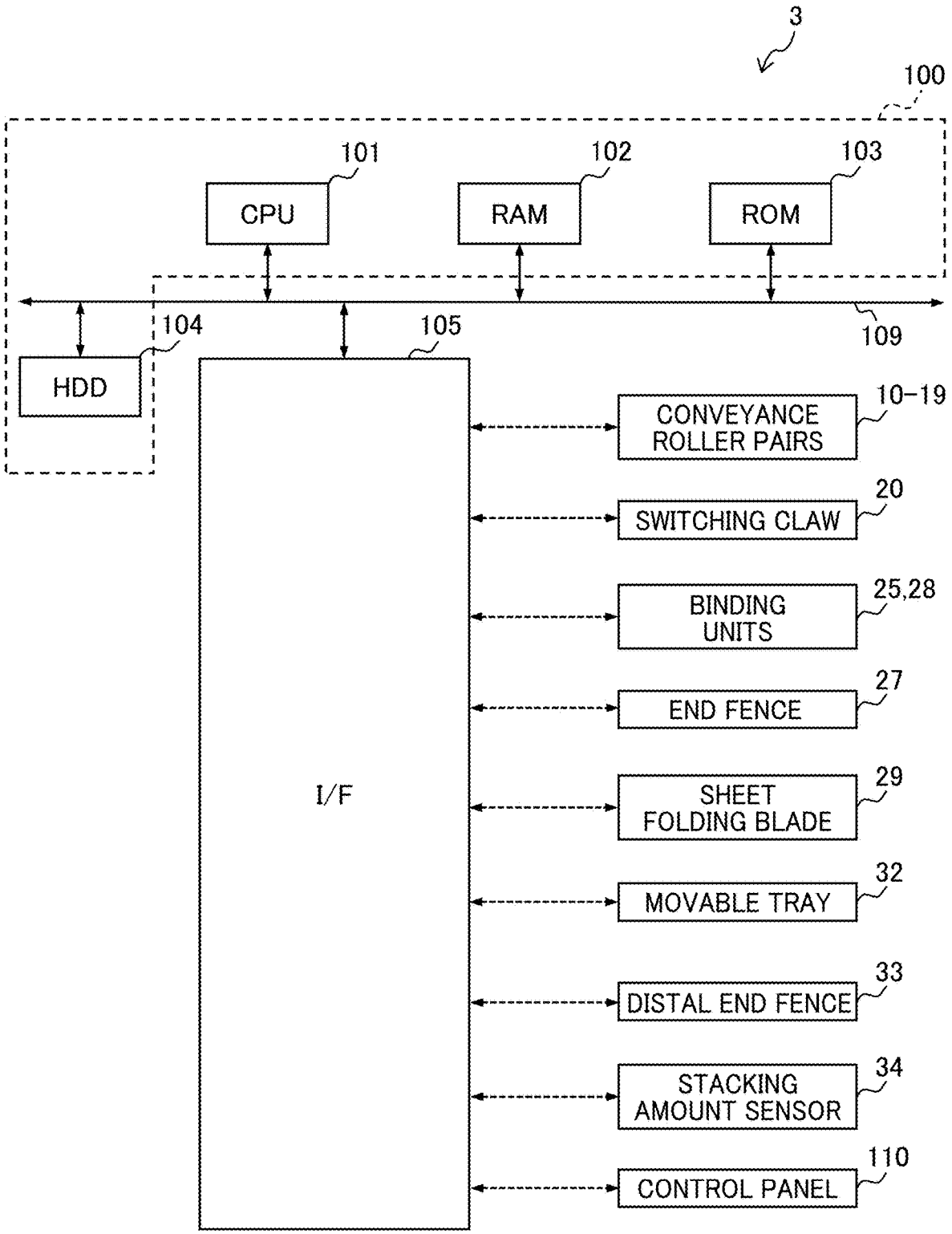
FIG. 4 is a schematic block diagram illustrating a hardware configuration of the post-processing apparatus of FIG. 2.

FIG. 4 is a schematic block diagram illustrating a hardware configuration of the post-processing apparatus 3 of FIG. 2.

As illustrated in FIG. 4, the post-processing apparatus 3 includes a central processing unit (CPU) 101, a random access memory (RAM) 102, a read only memory (ROM) 103, a hard disk drive (HDD) 104, and an interface (I/F) 105. The CPU 101, the RAM 102, the ROM 103, the HDD 104, and the I/F 105 are connected each other via a common bus 109.

The CPU 101 is an arithmetic unit and controls the overall operation of the post-processing apparatus 3. The RAM 102 is a volatile storage medium that allows data to be read and written at high speed. The CPU 101 uses the RAM 102 as a work area for data processing. The ROM 103 is a read-only non-volatile storage medium that stores programs such as firmware. The HDD 104 is anon-volatile storage medium that allows data to be read and written and has a relatively large storage capacity. The HDD 104 stores, e.g., an operating system (OS), various control programs, and application programs.

The post-processing apparatus 3 processes, by an arithmetic function of the CPU 101, e.g., a control program stored in the ROM 103 and an information processing program (or application program) loaded into the RAM 102 from a storage medium such as the HDD 104. Such processing configures a software controller including various functional modules of the post-processing apparatus 3. The software controller thus configured cooperates with hardware resources of the post-processing apparatus 3 construct functional blocks to implement functions of the post-processing apparatus 3. Specifically, the CPU 101, the RAM 102, the ROM 103, and the HDD 104 implement the controller 100 to control the operation of the post-processing apparatus 3.

The I/F 105 is an interface that connects the conveyance roller pairs 10 to 19, the switching claw 20, the binding units 25 and 28, the end fence 27, the sheet folding blade 29, the movable tray 32, the distal end fence 33, the stacking amount sensor 34, and a control panel 110, to the common bus 109. The controller 100 drives a motor through the I/F 105 to operate the conveyance roller pairs 10 to 19, the switching claw 20, the binding units 25 and 28, the end fence 27, the sheet folding blade 29, the movable tray 32, and the distal end fence 33.

More specifically, the controller 100 controls the operations of the conveyance roller pairs 10 to 19, the switching claw 20, the binding units 25 and 28, the end fence 27, and the sheet folding blade 29 to execute the post-processing on the sheet bundle Mb on which images are formed by the image forming apparatus 2. In addition, the controller 100 controls the operations of the movable tray 32 and the distal end fence 33 based on the stacking amount signal output from the stacking amount sensor 34. By so doing, the sheet bundle Mb subjected to the saddle stitching process is stacked on the sheet ejection tray 30 or is ejected from the sheet ejection tray 30.

The controller 100 may drive a motor to rotate the movable tray 32 and the distal end fence 33. Alternatively, the sheet ejection tray 30 may include an operation member that manually changes the positions of the movable tray 32 and the distal end fence 33. Further, a user may operate the operation member to rotate the movable tray 32 and the distal end fence 33. In this case, to reduce the force of a user operating the operation member, a speed reduction mechanism may be provided between the operation member and each of the movable tray 32 and the distal end fence 33.

The control panel 110 includes an operation unit that receives an operation instruction from the user and a display (notification unit) that notifies the user of information. The operation unit includes, for example, hard keys and a touch panel superimposed on a display. The control panel 110 acquires information from the user through the operation unit and provides the information to the user through the display. Note that a specific example of the notification unit is not limited to the display and may be an LED lamp or a speaker.

Figure 5:
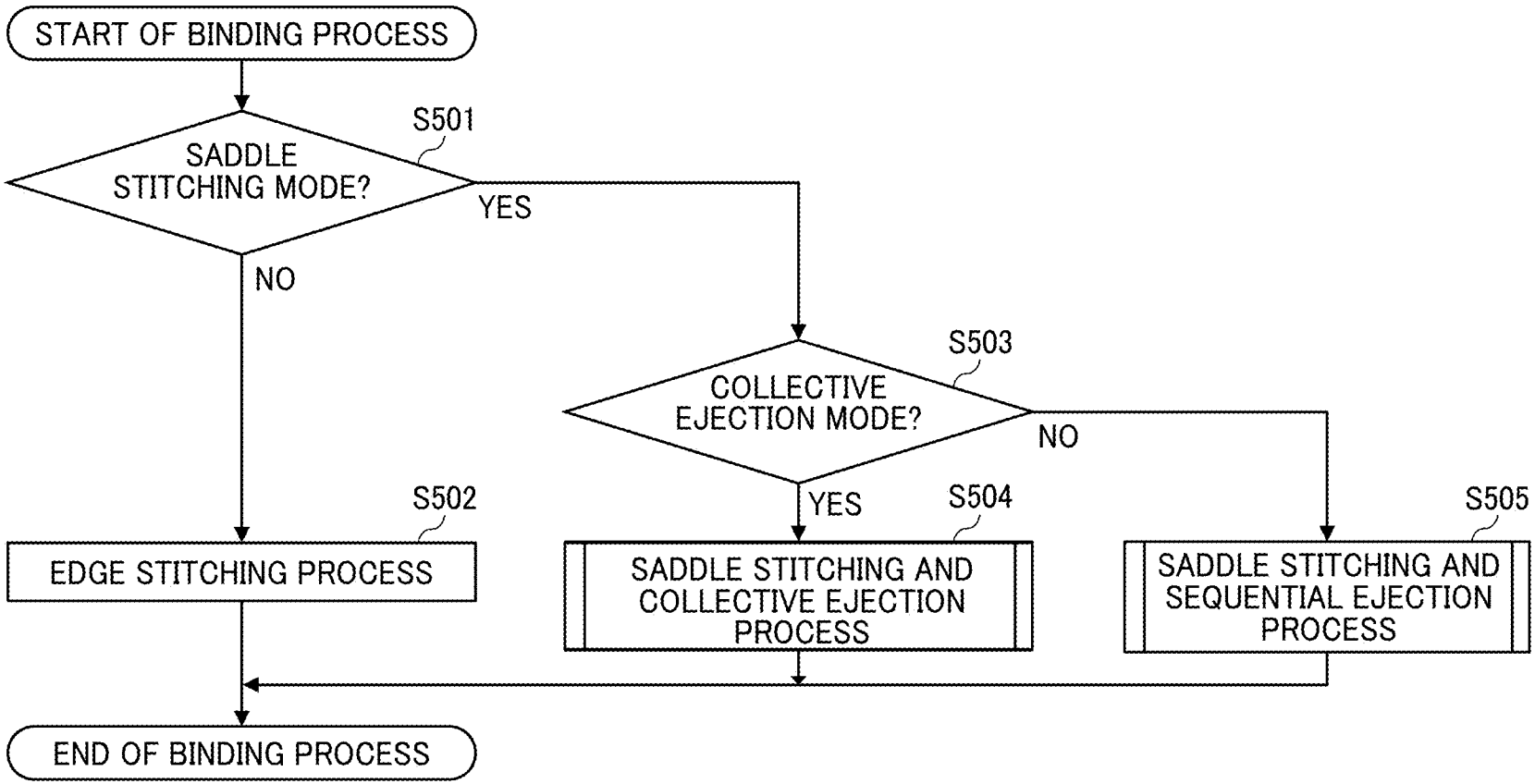
FIG. 5 is a flowchart of a binding process.

FIG. 5 is a flowchart of a binding process.

The controller 100 starts the binding process illustrated in FIG. 5, for example, at a timing when an instruction to execute the binding process (hereinafter, referred to as a "binding command") is acquired from the image forming apparatus 2. The binding command includes, for example, the number of sheets included in the sheet bundle Mb (hereinafter referred to as a "given number of sheets") and the number of sheet bundles Mb on which the binding process is executed (hereinafter referred to as a "requested number of copies").

The post-processing apparatus 3 is capable of selecting one of a plurality of binding modes. The binding modes include an edge stitching mode in which the edge stitching process is executed and a saddle stitching mode in which the saddle stitching process is executed. The post-processing apparatus 3 selects one of a plurality of ejection modes. The ejection modes include a collective ejection mode in which a plurality of sheet bundles Mb are stacked on the movable tray 32 and then collectively ejected, and a sequential ejection mode in which a sheet bundle Mb is ejected each time the conveyance roller pair 19 ejects the sheet bundle Mb. The binding modes and the ejection modes may be selected by the user through the control panel 110 or may be included in the binding command.

First, the controller 100 determines the selected binding mode (step S501). When the controller 100 determines that the edge stitching mode is selected (NO in step S501), the controller 100 executes the edge stitching process (step S502). The edge stitching process is a process in which an end of the sheet bundle Mb is bound by the edge stitching device. A detailed description of the edge stitching process is omitted.

On the other hand, when the controller 100 determines that the saddle stitching mode is selected (YES in step S501), the controller 100 determines whether a collective ejection mode or a sequential ejection mode is selected (step S503). When the controller 100 determines that the collective ejection mode is selected (YES in step S503), the controller 100 executes the saddle stitching and collective ejection process in FIG. 6 (step S504). On the other hand, when the controller 100 determines that the sequential ejection mode is selected (NO in step S503), the controller 100 executes the saddle stitching and sequential ejection process in FIG. 7 (step S505).

Figure 6:
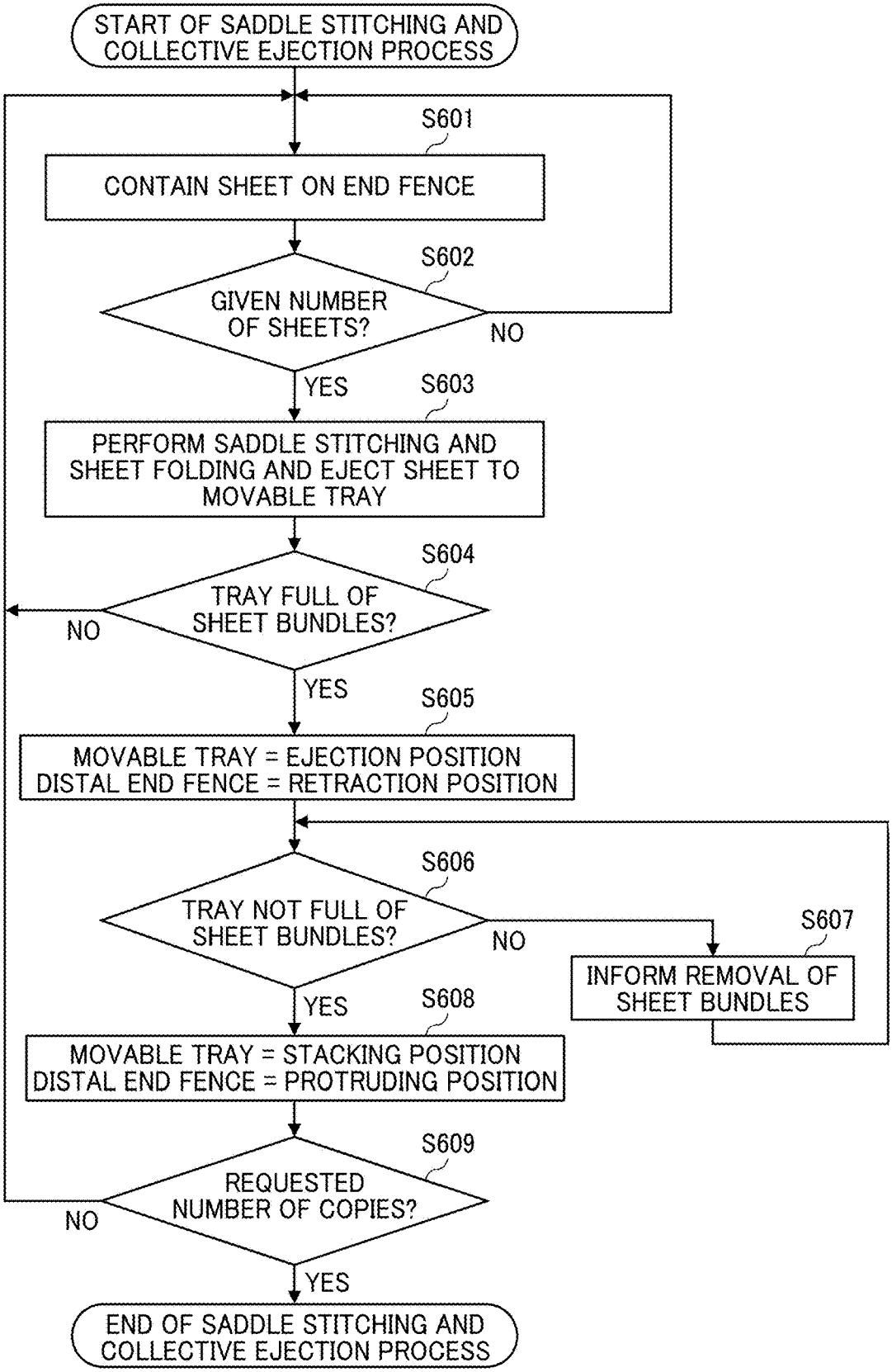
FIG. 6 is a flowchart of a saddle stitching and collective ejection process.

FIG. 6 is a flowchart of the saddle stitching and collective ejection process.

The saddle stitching and collective ejection process is a process of stacking the sheet bundle Mb stitched by the saddle stitching device on the movable tray 32 and collectively ejecting the sheet bundle Mb at a timing when the number of sheet bundles Mb stacked on the movable tray 32 reaches the threshold value. Note that, at the start of the saddle stitching and collective ejection process, the end fence 27 is at the binding position, the movable tray 32 is at the stacking position, and the distal end fence 33 is at the protruding position.

First, the controller 100 causes the conveyance roller pairs 10, 11, 14, 16, and 17 to rotate, so that the sheet on which the image is formed by the image forming apparatus 2 on the end fence 27 (step S601). Next, the controller 100 determines whether or not the number of sheets on the end fence 27 reaches the given number of sheets indicated by the binding command (step S602).

When the controller 100 determines that the number of sheets on the end fence 27 does not reach the given number of sheets (NO in step S602), the controller 100 executes the process of step S601 again. On the other hand, when the controller 100 determines that the number of sheets on the end fence 27 reaches the given number of sheets (YES in step S602), the controller 100 causes the sheet bundle Mb on the end fence 27 to be folded in half, and then causes the sheet bundle Mb to be ejected to the movable tray 32 at the stacking position (step S603).

More specifically, the controller 100 causes the binding unit 28 to bind the center of the sheet bundle Mb on the end fence 27 at the binding position. Next, the controller 100 causes the end fence 27 to move to the folding position. Next, the controller 100 causes the sheet folding blade 29 to fold the sheet bundle Mb on the end fence 27 at the folding position in half, and then causes the conveyance roller pair 18 to nip the sheet bundle Mb. Then, the controller 100 causes the conveyance roller pairs 18 and 19 to be rotated to eject the sheet bundle Mb to the movable tray 32 at the stacking position. Further, the controller 100 causes the end fence 27 and the sheet folding blade 29 to return to the original positions.

Next, the controller 100 determines whether or not the sheet bundle Mb are fully stacked on the movable tray 32 at the stacking position based on the stacking amount signal output from the stacking amount sensor 34 (step S604). Hereinafter, the state in which the sheet bundles Mb are fully stacked on the movable tray 32 at the stacking position is referred to as a "fully stacked state." In other words, the controller 100 determines whether or not the number of sheet bundles Mb detected by the stacking amount sensor 34 reaches a threshold value. Then, when the controller 100 determines that the number of sheet bundles Mb stacked on the movable tray 32 at the stacking position is smaller than the threshold value (NO in step S604), the controller 100 executes the processing after step S601 again.

On the other hand, when the controller 100 determines that the number of sheet bundles Mb stacked on the movable tray 32 at the stacking position reaches the threshold value (YES in step S604), the controller 100 causes the movable tray 32 to change to the ejection position and causes the distal end fence 33 to change to the retraction position (step S605). As the controller 100 executes the processing of step S605, the sheet bundles Mb fully stacked on the movable tray 32 are ejected from the sheet ejection tray 30 along the upper face of the movable tray 32 and the upper face of the main tray 31.

However, it is likely that the movable tray 32 is caught by any obstacle and fails to change the position of the movable tray 32 to the ejection position. Further, even if the position of the movable tray 32 changes to the ejection position, it is likely that the sheet bundle Mb is caught by any obstacle and fails to slide down. In order to address such inconveniences, after step S605, the controller 100 determines whether or not the sheet bundle Mb is ejected from the movable tray 32, in other words, the full stacked state is cancelled, based on the stacking amount signal output from the stacking amount sensor 34 (step S606).

When the controller 100 determines that the full stacked state of the movable tray 32 is not cancelled (NO in step S606), the controller 100 causes the display to display a message prompting removal of the sheet bundles Mb on the movable tray 32 (step S607), and then repeats step S606 until the controller 100 determines that the full stacked state of the movable tray 32 is cancelled. The controller 100 continues to display the message until the full stacked state is cancelled. In addition, the notification method is not limited to displaying a message and may be lighting of a light-emitting diode (LED) lamp or an output of a guide sound through a speaker. Then, a user received this notification may operate the operation unit to forcibly change the position of the movable tray 32 or may manually remove the sheet bundle Mb from the movable tray 32.

Next, when the controller 100 determines that the full stacked state of the movable tray 32 is cancelled (YES in step S606), the controller 100 causes the movable tray 32 to change to the stacking position and causes the distal end fence 33 to change to the protruding position (step S608). Next, the controller 100 determines whether or not the number of sheet bundles Mb reaches a requested number of copies indicated by the binding command (step S609). When the controller 100 determines that the number of sheet bundles Mb does not reach the requested number of copies (NO in S609), the controller 100 executes the processing of step S601 again. On the other hand, when the controller 100 determines that the number of sheet bundles Mb reaches the requested number of copies (YES in S609), the controller 100 ends the saddle stitching and collective ejection process.

Figure 7:
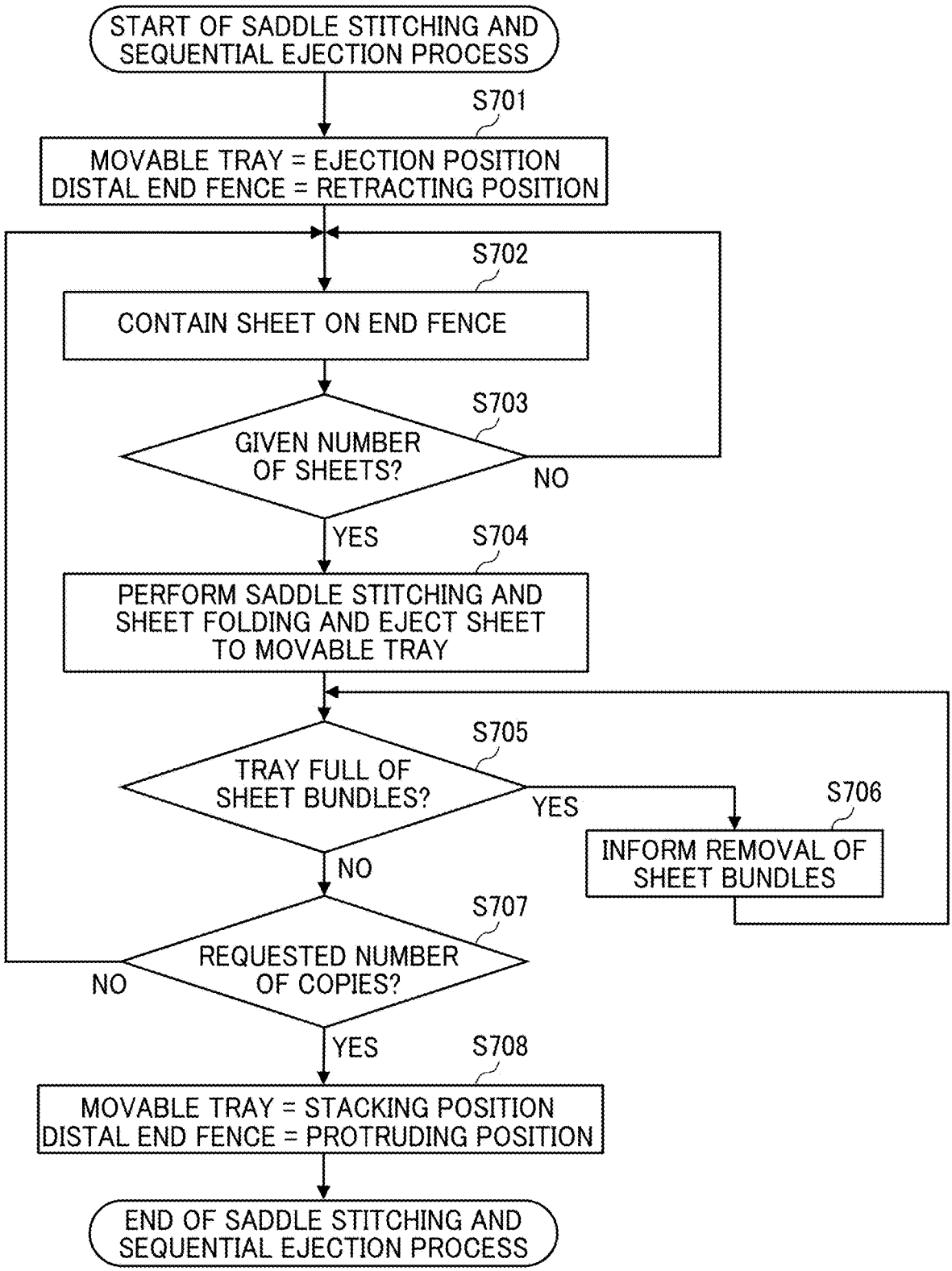
FIG. 7 is a flowchart of a saddle stitching and sequential ejection process.

FIG. 7 is a flowchart of the saddle stitching and sequential discharge process.

The saddle stitching and sequential discharge process is a process of sequentially ejecting the sheet bundles Mb stitched by the saddle stitching device from the sheet ejection tray 30 without stacking the sheet bundles Mb on the movable tray 32. Note that, at the start of the saddle stitching and sequential ejection process, the end fence 27 is at the binding position, the movable tray 32 is at the stacking position, and the distal end fence 33 is at the protruding position. In addition, a detailed description of the features of the saddle stitching and sequential ejection process common to the saddle stitching and collective ejection process is omitted and a description of the features of the saddle stitching and sequential ejection process different from the features of the saddle stitching and collective ejection process is mainly described. A main difference between the saddle stitching and collective ejection process and the saddle stitching and sequential ejection process is a timing at which the position of the movable tray 32 and the position of the distal end fence 33 are changed.

First, the controller 100 causes the movable tray 32 to change to the ejection position and causes the distal end fence 33 to change to the retraction position (S701). The processing of step S701 of the flowchart in FIG. 7 is common to the processing of step S605 of the flowchart in FIG. 6. Next, the controller 100 executes the saddle stitching process on the sheet bundle Mb to fold the sheet bundle Mb in half, and then cause the sheet bundle Mb to be ejected to the movable tray 32 (steps S702 to S704). The processing of steps S702 to S704 of the flowchart in FIG. 7 is common to the processing of steps S601 to S603 of the flowchart in FIG. 6.

The sheet bundle Mb ejected to the movable tray 32 in step S704 is supposed to slide down on the upper face of the movable tray 32 and the upper face of the main tray 31 at the ejection position to be ejected from the sheet ejection tray 30. However, it is likely that the sheet bundle Mb ejected by the conveyance roller pair 19 is caught by any obstacle and fails to slide down on the movable tray 32.

In order to address such inconveniences, after step S704, the controller 100 determines whether or not the movable tray 32 is fully stacked with the sheet bundles Mb based on the stacking amount signal output from the stacking amount sensor 34 (step S705). When the controller 100 determines that the movable tray 32 is fully stacked with the sheet bundles Mb (YES in step S705), the controller 100 causes the display to display a message prompting removal of the sheet bundles Mb on the movable tray 32 (step S706), and then repeats step S705 until the controller 100 determines that the movable tray 32 is not fully stacked with the sheet bundles Mb. The processing of steps S705 to S706 of the flowchart in FIG. 7 is common to the processing of steps S606 to S607 of the flowchart in FIG. 6. Next, the controller 100 determines whether or not the movable tray 32 is not fully stacked with the sheet bundles Mb (NO in step S705), the controller 100 determines whether or not the number of sheet bundles Mb reaches a requested number of copies indicated by the binding command (step S707). The processing of step S707 of the flowchart in FIG. 7 is common to the processing of step S609 of the flowchart in FIG. 6.

When the controller 100 determines that the number of sheet bundles Mb does not reach the requested number of copies (NO in S707), the controller 100 executes the processing of step S702 and the following steps again. On the other hand, when the controller 100 determines that the number of sheet bundles Mb stacked on the movable tray 32 reaches the requested number of copies (YES in step S707), the controller 100 causes the movable tray 32 to change to the stacking position and causes the distal end fence 33 to change to the protruding position (step S708). The processing of step S708 of the flowchart in FIG. 7 is common to the processing of step S608 of the flowchart in FIG. 6.

According to the above-described embodiment, the following operational effects, for example, are achieved.

According to the above-described embodiment, since the movable tray 32 is rotatable between the stacking position and the ejection position, the sheet bundle Mb is ejected at an appropriate timing while obtaining the stacking amount when the sheet bundle Mb is desired to be stacked.

In addition, as in the above-described embodiment, the upper face of the movable tray 32 is horizontal when the movable tray 32 is at the stacking position and is inclined downward along the upper face of the main tray 31 when the movable tray 32 is at the ejection position. By so doing, the above-described functions are achieved with a simple configuration. However, the stacking position and the ejection position of the movable tray 32 are not limited to the positions illustrated in FIGS. 3A and 3B as long as the above-described functions are achieved.

In addition, according to the above-described embodiment, changing the position of the movable tray 32 and the position of the distal end fence 33 in conjunction with each other achieves ejection of the sheet bundle Mb from the sheet ejection tray 30 in one process. However, the position of the movable tray 32 and the position of the distal end fence 33 may be changed separately.

Further, according to the above-described embodiment, the movable tray 32 is slidable so that the upper face of the movable tray 32 at the ejection position and the upper face of the main tray 31 are continuously extended as a single face. Accordingly, when the position of the movable tray 32 is changed from the stacking position to the ejection position, the sheet bundle Mb is prevented from being caught in the gap between the movable tray 32 and the main tray 31 and failing to be ejected.

In addition, as in the above-described embodiment, the operation member in which a user manually changes the position of the movable tray 32 achieves the position change of the movable tray 32 with a simple configuration. However, the post-processing apparatus 3 according to the above-described embodiment may include the function of the controller 100 changing the position of the movable tray 32, the function of the user manually changing the position of the movable tray 32, or both.

Further, according to the saddle stitching and collective ejection process, when the movable tray 32 is fully stacked, the movable tray 32 changes to the ejection position. By so doing, the stacking amount of the sheet bundles Mb on the movable tray 32 is obtained and the sheet bundle Mb is ejected at an appropriate timing. However, as in the saddle stitching and sequential ejection process, the sheet bundle Mb to be ejected by the conveyance roller pair 19 may be sequentially ejected without being stacked on the movable tray 32.

The sheet ejection tray 30 according to the above-described embodiment supports the sheet bundle Mb to be ejected from the saddle stitching device. However, the sheet ejection tray 30 may support the sheet bundle Mb to be ejected from the edge stitching device or may support sheets subjected to another post-processing such as a punching process in which multiple through holes are formed in the sheet.

The control method described above may be implemented by, for example, a program. That is, the control method may be executed by causing an arithmetic device, a storage device, an input device, an output device, and a control device to operate in cooperation with each other based on a program. In addition, the program may be written in, for example, a storage device or a storage medium and distributed, or may be distributed through, for example, an electric communication line.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A post-processing apparatus comprising:

a post-processor to execute post-processing on a medium on which an image is formed by an image forming apparatus;

an ejector to eject the medium on which the post-processing is executed by the post-processor; and an ejection tray to hold the medium ejected by the ejector, the ejection tray including:

a main tray having an upper face inclined downward in an ejection direction; and a movable tray being rotatably supported by the main tray between a stacking position at which the medium ejected by the ejector remains stacked on the upper face of the main tray and an ejection position at which the medium ejected by the ejector slides along the upper face of the main tray, wherein the movable tray includes a support shaft, wherein the main tray includes a guide groove supporting the support shaft rotatably, the guide groove supporting the support shaft slidably in an inclination direction of the main tray, and wherein the movable tray at the ejection position is to:

slide toward a root of the main tray to rotate to the stacking position; and slide toward a distal end of the main tray so that the upper face of the main tray and an upper face of the movable tray continuously extend as a single face.

2. The post-processing apparatus according to claim 1, wherein the stacking position is a horizontal position of an upper face of the movable tray, and wherein the ejection position is an inclined downward position of the movable tray.

3. The post-processing apparatus according to claim 1, wherein the ejection tray includes a distal end fence that is rotatably supported by the main tray between a protruding position and a retraction position, wherein the distal end fence is to:

project upward from the upper face of the main tray at the protruding position to prevent ejection of the medium; and retract from the upper face of the main tray at the retraction position to allow the ejection of the medium, and wherein the distal end fence is to:

move to the protruding position along with movement of the movable tray to the stacking position; and move to the retraction position along with movement of the movable tray to the ejection position.

4. The post-processing apparatus according to claim 1, further comprising:

a stacking amount sensor to detect a number of media stacked on the movable tray at the stacking position; and circuitry configured to cause the movable tray to rotate from the stacking position to the ejection position in response to the number of media detected by the stacking amount sensor reaching a threshold.

5. The post-processing apparatus according to claim 1, wherein the post-processing is saddle stitching that binds a center of a sheet bundle.

6. An image forming system comprising:

an image forming apparatus to form an image on a medium; and a post-processing apparatus to execute post-processing on the medium on which the image is formed by the image forming apparatus, the post-processing apparatus comprising:

a post-processor to execute post-processing on the medium including the image formed by the image forming apparatus;

an ejector to eject the medium on which the post-processing is executed by the post-processor; and an ejection tray to hold the medium ejected by the ejector, the ejection tray including:

a main tray having an upper face inclined downward in an ejection direction; and a movable tray being rotatably supported by the main tray between a stacking position at which the medium ejected by the ejector remains stacked on the upper face of the main tray and an ejection position at which the medium ejected by the ejector slides along the upper face of the main tray, wherein the movable tray includes a support shaft, wherein the main tray includes a guide groove supporting the support shaft rotatably, the guide groove supporting the support shaft slidably in an inclination direction of the main tray, and wherein the movable tray at the ejection position is to:

slide toward a root of the main tray to rotate to the stacking position; and slide toward a distal end of the main tray so that the upper face of the main tray and an upper face of the movable tray continuously extend as a single face.

7. A post-processing apparatus comprising:

means for post-processing to execute post-processing on a medium on which an image is formed by an image forming apparatus;

means for ejecting the medium on which the post-processing is executed by the means for post-processing; and an ejection tray to hold the medium ejected by the means for ejecting, the ejection tray including:

a main tray having an upper face inclined downward in an ejection direction; and a movable tray being rotatably supported by the main tray between a stacking position at which the medium ejected by the means for ejecting remains stacked on the upper face of the main tray and an ejection position at which the medium ejected by the means for ejecting slides along the upper face of the main tray, wherein the movable tray includes a support shaft, wherein the main tray includes a guide groove supporting the support shaft rotatably, the guide groove supporting the support shaft slidably in an inclination direction of the main tray, and wherein the movable tray at the ejection position is to:

slide toward a root of the main tray to rotate to the stacking position; and slide toward a distal end of the main tray so that the upper face of the main tray and an upper face of the movable tray continuously extend as a single face.

8. The post-processing apparatus according to claim 7, wherein the stacking position is a horizontal position of an upper face of the movable tray, and wherein the ejection position is an inclined downward position of the movable tray.

9. The post-processing apparatus according to claim 7, wherein the ejection tray includes a distal end fence that is rotatably supported by the main tray between a protruding position and a retraction position, wherein the distal end fence is to:

project upward from the upper face of the main tray at the protruding position to prevent ejection of the medium; and retract from the upper face of the main tray at the retraction position to allow the ejection of the medium, and wherein the distal end fence is to:

move to the protruding position along with movement of the movable tray to the stacking position; and move to the retraction position along with movement of the movable tray to the ejection position.

10. The post-processing apparatus according to claim 7, further comprising:

a stacking amount sensor to detect a number of media stacked on the movable tray at the stacking position; and circuitry configured to cause the movable tray to rotate from the stacking position to the ejection position in response to the number of media detected by the stacking amount sensor reaching a threshold.

11. The post-processing apparatus according to claim 7, wherein:

the post-processing is saddle stitching that binds a center of a sheet bundle.

* * * * *